US007168120B2

(12) United States Patent
Habif et al.

(10) Patent No.: US 7,168,120 B2
(45) Date of Patent: Jan. 30, 2007

(54) PRESSURE-FED VACUUM SWIMMING POOL CLEANING ROBOT

(76) Inventors: Jacques-Alexandre Habif, 48 rue du 19 Janvier, Garches (FR) 92380; Marc Idoine, Le Chartil 28 rue des Cavins, Chassemy (FR) 02370

( * ) Notice: Subject to any disclaimer, the term of this patent is extended or adjusted under 35 U.S.C. 154(b) by 350 days.

(21) Appl. No.: 10/333,795

(22) PCT Filed: Jun. 28, 2001

(86) PCT No.: PCT/FR01/02068

§ 371 (c)(1),
(2), (4) Date: Jul. 16, 2003

(87) PCT Pub. No.: WO02/08547

PCT Pub. Date: Jan. 31, 2002

(65) Prior Publication Data

US 2004/0010867 A1 Jan. 22, 2004

(30) Foreign Application Priority Data

Jul. 24, 2000 (FR) ..... 00 09682

(51) Int. Cl.
*E04H 4/16* (2006.01)

(52) U.S. Cl. ..... 15/1.7; 15/408; 15/409

(58) Field of Classification Search ..... 15/1.7, 15/408, 409; 210/169
See application file for complete search history.

(56) References Cited

U.S. PATENT DOCUMENTS

| | | | | |
|---|---|---|---|---|
| 2,725,356 | A * | 11/1955 | Lombardi | 210/805 |
| 5,014,382 | A * | 5/1991 | Kallenbach | 15/1.7 |
| 5,099,535 | A | 3/1992 | Chauvier et al. | |
| 5,706,540 | A * | 1/1998 | Niewiarowski | 15/1.7 |
| 5,802,653 | A * | 9/1998 | Roumagnac | 15/1.7 |
| 6,398,878 | B1 * | 6/2002 | Henkin et al. | 134/18 |
| 6,782,578 | B1 * | 8/2004 | Rief et al. | 15/1.7 |

FOREIGN PATENT DOCUMENTS

| | | |
|---|---|---|
| EP | 0 633 371 | 1/1995 |
| EP | 0 721 033 | 7/1996 |
| EP | 0 741 219 | 11/1996 |
| FR | 2 302 151 | 9/1976 |
| GB | 1 477 128 | 6/1977 |
| WO | WO 00/23675 | 4/2000 |

* cited by examiner

*Primary Examiner*—Gladys J P Corcoran
*Assistant Examiner*—S Karls
(74) *Attorney, Agent, or Firm*—Leydig, Voit & Mayer, Ltd.

(57) ABSTRACT

An automatic swimming pool cleaning robot is disclosed, comprising a body, a suction head, an unstable valve, a suction pipe having an upper end, a recuperating filter connected to the upper end, and a venturi injector, wherein the unstable valve is activated to activate the robot. The robot combines the advantages of vacuum-fed robots and pressure-fed robots.

9 Claims, 2 Drawing Sheets

PRESSURE-FED VACUUM SWIMMING POOL CLEANING ROBOT

Figure 1:
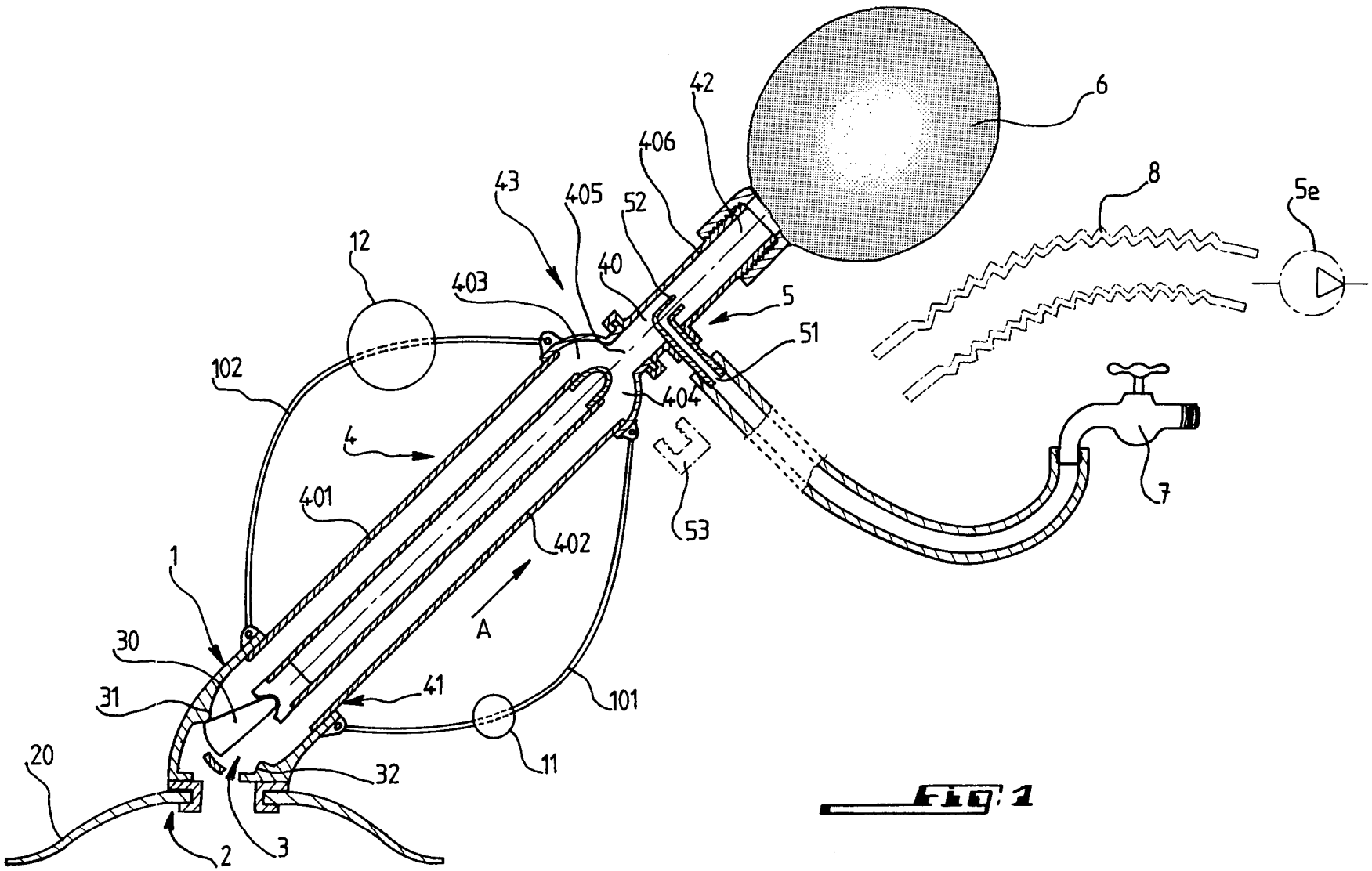

In general, the present invention concerns the field of swimming pool maintenance equipment.

More precisely, according to one of its features, the invention concerns an automatic swimming pool cleaning robot, comprising at least a body terminated by a suction head, an astable valve housed in the body, and a suction pipe, the first end of which is attached to the body and connected to the suction head via the astable valve and for which a lengthwise section, following the first end and forming or preceding a second end of the pipe in one direction of suction, is, during operation, subjected to a vacuum generated by a vacuum source, the astable valve being put in motion by the vacuum and discontinuously putting the suction head in communication with the second end of the pipe.

Robots of this type are well known in the prior art, such as those disclosed, for example, in Patent Nos. FR 2 302 151, U.S. Pat. No. 5,014,382, or EP 0 633 371.

Regardless of type, the automatic swimming pool cleaning robots are designed to be immersed in a swimming pool and to move by themselves at the bottom of the swimming pool while drawing up impurities and possible foreign matter that may be found there.

Conventionally, these robots are placed in two categories based on to whether they are activated by a suction pump or by a pressurized water source.

In general, the movements of the robots of the first type are obtained by recovery of the kinetic energy of a water current periodically established and abruptly interrupted, while those of the second type are moved either as a result of a motor with blades fed by the pressurized water source or by the ejection of a water current and conservation of the amount of movement, like a rocket.

However, the technical characteristics of these robots depend, rather markedly, on the category to which they belong.

Thus, the robots activated by a suction pump are usually lighter, such that, if applicable, they may clean not only the flat bottoms of a swimming pool, but also the sloping side and even the vertical walls.

The vacuum-fed robots also have the advantage of containing only a small number of moving parts, which, moreover, present excellent robustness with respect to any source of contamination or wear and tear, in comparison with the propellers, belts and, possibly, ball bearings which the pressure-fed robots generally comprise.

However, to avoid the use of an additional suction pump, the vacuum-fed robots are usually connected to the filtrating pump of the swimming pool, such that they cannot be used permanently.

For their part, while the pressure-fed robots may be effectively used permanently, on the other hand their weight is such that they generally require the use of a compressor.

Finally, while the pressure-fed robots are immediately operational when started up, the vacuum-fed robots are possibly subject to priming defects, which can only be controlled by additional manipulations.

The invention in this context has the object of proposing a cleaning robot that combines at least one advantage of pressure-fed robots with those of vacuum-fed robots.

For this purpose, the robot of the invention, which moreover conforms to the generic definition given by the preamble above, is essentially characterized in that it also comprises a recuperation filter that, during operation, is selectively connected to the second end of the pipe and a Venturi injector arranged on said lengthwise section of pipe and presenting an inlet orifice, exterior to the pipe and, during operation, is selectively connected to a pressurized water source and an outlet nozzle, internal to the pipe, and pointing approximately in the direction of suction, this injector itself forming the vacuum source during operation.

Not only does such a robot retain all of the advantages of a vacuum-fed robot, whose structure and principle of movement it keeps, but it also acquires the advantages of pressure-fed robots, especially the ability to be immediately operational upon being started and the possibility of being used permanently.

Moreover, due to moderate weight, such a robot operates without requiring a compressor, so it manages to reduce a widespread inconvenience in the category of pressure-fed robots.

In addition, the robot of the invention may contain a plug selectively sealing the inlet orifice of the injector, and be designed such that the filter is removably connected to the second end of the pipe, so this robot may also be operated by sealing the inlet orifice of the injector and connecting the second end of the pipe to an external vacuum source, in the manner of a standard vacuum-fed robot.

In one possible, but nonlimiting, embodiment of the invention, the nine may consist of two passages connected to the body at its first end, a three-branched mutually communicating connection, which includes two lateral branches connecting the two passages to each other and a central branch, and a common conduit connecting the central branch of the connection to the second end of the pipe, the injector being installed on the common conduit of the pipe.

Likewise, the astable valve may comprise at least a first seat subject to the vacuum and a closing element pivoting between a sealing position in which it seals the first seat, and a release position in which it is released from the first seat, a return movement system being provided so that the pivoting closing element, at least when it reaches either the closed or disengaged position is drawn to the other of said positions.

The invention also concerns a method for functional utilization of an automatic swimming pool cleaning robot designed to be vacuum fed, where said method is characterized in that it contains a step consisting of equipping this robot with a selectively pressure-fed Venturi injector.

Figure 2:
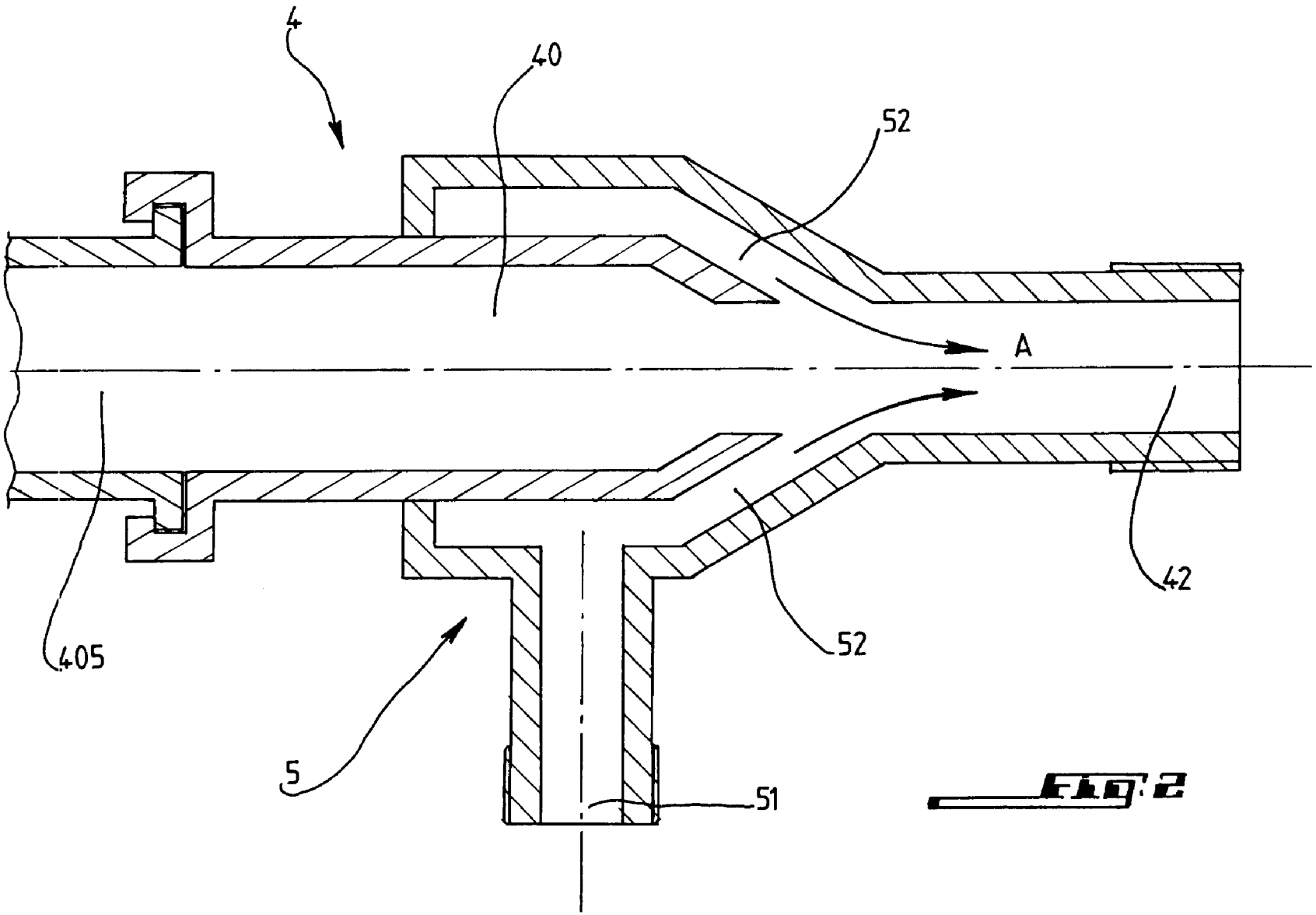

Other characteristics and advantages of the invention, for information only and in no way restrictive, will be clearly brought out with the description given below with reference to the attached drawing in which:

FIG. 1 is a diagrammatic sectional view of a robot integrating the main characteristics of the invention as well as optional characteristics given by way of example; and FIG. 2 is a detailed view of an enlarged section, having the same reference numbers as FIG. 1 and essentially representing a variant of the Venturi injector.

In a known way, a robot in accordance with the invention consists of body 1, a suction head 2, an astable valve 3, and a suction pipe 4.

The astable valve 3 is housed in the body 1, which is terminated by the suction head 2, itself provided with a skirt 20 which, during operation, is applied to the surface to be cleaned.

A first end 41 of the suction pipe 4, which forms the lower end of this pipe when the robot is resting on the bottom of the swimming pool, is attached to the body 1 and connected to the suction head 2 via the astable valve 3.

The second end 42 of the suction pipe 4, which forms the upper end of this pipe when the robot is resting on the bottom of the swimming pool, follows the first end 41 in the direction of suction indicated by arrow A.

In the case of known vacuum-fed robots, the second end 42 of the pipe 4 is connected to a vacuum source formed by a return pump 5*e* through a flexible tube 8, the vacuum generated by this pump 5*e* being set up especially in the lengthwise section 40 of the pipe 4, intermediately between the first end 41 and the second end 40 or forming this latter.

As a result of this vacuum, which is transmitted up to the first end 41 of the pipe 4, the astable valve 3 is put in motion, and it puts the suction head 2 discontinuously in communication with the second end 42 of the pipe 4; that is, the flow of water established by the vacuum between the suction head 2 and the lengthwise section 40 of the pipe 4 is interrupted and is neither steady nor, a fortiori, constant.

Also in a known way, the robot is equipped with a lower support 101 and an upper support 102 on which are mounted, respectively, in separately controllable positions, a weight 11 and a float 12 which together ensure the stability of the robot in the water.

The robot of the invention specifically also comprises a recuperation filter 6 and a Venturi injector 5.

As the figure shows, the recuperation filter 6 for example, has the form of a pocket and, during operation, is connected, to the second end 42 of the pipe 4, preferably so that it can be removed.

The object of the Venturi injector 5 is to form, during operation, the vacuum source, especially necessary for the operating of the astable valve 3.

This injector 5 is set up on the lengthwise section 40 of the pipe 4 and presents an inlet orifice 51 which is external to the pipe 4 and which is connected during operation to a pressurized water source such as a tap 7, and an outlet nozzle 52 which is provided on the interior of the pipe 4 and which points at least approximately in the direction of suction A, so as to make the water originating from the tap 7 circulate along this direction A.

If the robot of the invention contains in addition a plug 53 capable of sealing the inlet orifice 51 of the injector 5, and if the filter 6 is well connected to the second end 42 of the pipe 4 in such a way that it is removable, then this robot may also be run in a conventional manner, by connecting the second end 42 of the pipe 4 to the external vacuum source 5*e* and sealing the inlet orifice 51 of the injector with the plug 53.

Although the invention may be illustrated for a specific type of vacuum robot, it is applicable to all vacuum robots, and in particular to those in which the movement is obtained by periodic interruption of a flow of water put in motion by suction.

In general, and especially in the specific illustrated application, the astable valve 3 consists of a pivoting closing element which, as it were, takes the form of a wedge hammer 30 and which interacts with at least one valve seat such as 31, subject to the vacuum.

The block stop 30 is arranged and stressed so as to pivot between a closed position, in which it seals the seat 31, and a disengaged position, in which it is released from this seat 31.

For this purpose, when it reaches either its closed or disengaged position, the block stop 30 is drawn towards the other of these two positions.

In the particular embodiment illustrated, the valve in fact consists of a second seat 32 approximately symmetrical to the seat 31 compared to the intermediate position of the block stop 30, and this latter is, in a known way, alternately drawn towards seat 31 and towards seat 32 by the water current which is alternately established near seat 32 and seat 31, respectively.

This is realized in that pipe 4 consists of two rigid passages 401 and 402 which, at the first end 41 of this pipe, are mounted directly on body 1 and, at the second end 42 of the pipe 4, are connected via a connector 43 with three branches.

The three branches 403, 404 and 405 of the connector 43 communicate with each other and consist of two lateral branches 403 and 404 and a central branch 405.

As shown in the figure, the lateral branches 403 and 404 connect the two passages 401 and 402 to each other.

The central branch 405 leads to a common conduit 406 which defines the second end 42 of the pipe 4 and on which is installed the injector 5.

When the common conduit 406 is put under vacuum while the closing element is applied to the seat 31, no circulation of water is possible through the passage 401 while a water current with increasing speed is established through passage 402.

Under these conditions, the difference between the pressures that are established on the lateral surfaces of the closing element 30 causes an attraction of said closing element towards the seat 32.

As soon as the closing element 30 is applied to the seat 32, the flow of water that was established with relatively high speed in the passage 402 is abruptly interrupted, the kinetic energy of said flow being transmitted to the rigid structure of the robot.

However, at this instant, the water present in the passage 401 still has no or very low speed, such that the head 2 is no longer affected by the suction generated in the common conduit 406 and such that it may be easily lifted off the surface during cleaning.

Thus, insofar as the robot has total freedom of movement relative to this surface and insofar as its rigid structure receives the kinetic energy of the interrupted flow, it undergoes a displacement.

Since seat 31 has been released by the closing element 30, a flow of water with increasing speed is established in the passage 401.

Under these conditions, the closing element 30 is drawn towards the closing element 31 and a new operating cycle begins that is identical to that just described.

What is claimed is:

1. An automatic swimming pool cleaning robot, comprising a body terminated by a suction head;

an astable valve housed in the body;

a suction pipe having a lengthwise section and including a first lower end and a second upper end, the first lower end being attached to the body and connected to the suction head via the astable valve, the astable valve being put in motion by vacuum generated by a vacuum source and discontinuously putting the suction head in communication with the second upper end of the suction pipe;

a recuperation filter that, during operation, is selectively connected to the second upper end of the suction pipe; and a venturi injector installed on the lengthwise section of the suction pipe on the second upper end of the suction pipe, the venturi injector including an inlet orifice and an outlet nozzle, the venturi injector presenting the inlet orifice exterior to the suction pipe, and including the outlet nozzle interior to the suction pipe and pointing approximately in the direction of suction, the inlet orifice, during operation, being selectively connected to a pressurized water source, wherein the venturi injector forms the vacuum source during operation;

and a plug selectively sealing the inlet orifice, wherein the recuperating filter is removably connected to the second upper end of the suction pipe and when the filter is removed and the plug seals the inlet orifice of the injector, the robot can also be operated by connecting the second upper end of the suction pipe to an external vacuum source.

2. The robot according to claim 1, wherein the suction pipe includes two passages connected to the body at the first lower end of the suction pipe and the robot further comprises:

a connection with three mutually communicating branches, the branches being two lateral branches and a central branch, the two lateral branches connecting the two passages to each other and to the central branch; and a common conduit connecting the central branch to the second upper end of the suction pipe, wherein the injector is installed on the common conduit.

3. The robot according to claim 2, wherein the astable valve includes at least a first seat subject to the vacuum and a pivoting closing element, the closing element pivoting between a closed position in which it seals the first seat, and a disengaged position in which it is released from the first seat, and in which the closing element, at least when it reaches either the closed or the disengaged position, is drawn to the other of said positions.

4. The robot according to claim 1, wherein the astable valve includes at least a first seat subject to the vacuum and a pivoting closing element, the closing element pivoting between a closed position in which it seals the first seat, and a disengaged position in which it is released from the first seat, and in which the closing element, at least when it reaches either the closed or disengaged position, is drawn to the other of said positions.

5. The robot according to claim 1, wherein the plug seals the inlet orifice of the injector and the second upper end of the pipe is connected to an external vacuum source.

6. The robot according to claim 1, wherein the plug seals the inlet orifice of the injector, the filter is removed from the second upper end of the suction pipe and the second upper end of the pipe is connected to an external vacuum source.

7. The robot according to claim 1 wherein the astable valve comprises a wedge hammer.

8. An automatic swimming pool cleaning robot, comprising a body terminated by a suction head;

an astable valve housed in the body;

a suction pipe having a lengthwise section and including a first lower end and a second upper end, the first lower end being attached to the body and connected to the suction head via the astable valve and the suction pipe includes two passages connected to the body at the first lower end of the suction pipe, the astable valve being put in motion by vacuum generated by a vacuum source and discontinuously putting the suction head in communication with the second upper end of the suction pipe;

a recuperation filter that, during operation, is selectively connected to the second upper end of the suction pipe; and a venturi injector installed on the lengthwise section of the suction pipe on the second upper end of the suction pipe, the venturi injector including an inlet orifice and an outlet nozzle, the venturi injector presenting the inlet orifice exterior to the suction pipe, and including the outlet nozzle interior to the suction pipe and pointing approximately in the direction of suction, the inlet orifice, during operation, being selectively connected to a pressurized water source, wherein the venturi injector forms the vacuum source during operation;

a plug selectively sealing the inlet orifice, wherein the recuperating filter is removably connected to the second upper end of the suction pipe so that the robot may also be operated by sealing the inlet orifice of the injector and connecting the second upper end of the suction pipe to an external vacuum source;

a connection with three mutually communicating branches, the branches being two lateral branches and a central branch, the two lateral branches connecting the two passages to each other and to the central branch; and a common conduit connecting the central branch to the second upper end of the suction pipe, wherein the injector is installed on the common conduit.

9. The robot according to claim 8, wherein the astable valve includes at least a first seat subject to the vacuum and a pivoting closing element, the closing element pivoting between a closed position in which it seals the first seat, and a disengaged position in which it is released from the first seat, and in which the closing element, at least when it reaches either the closed or the disengaged position, is drawn to the other of said positions.

* * * * *